US007156747B2

(12) United States Patent
Perry

(10) Patent No.: US 7,156,747 B2
(45) Date of Patent: Jan. 2, 2007

(54) GOLF SWING STANCE STABILIZER

(75) Inventor: Alvin Sharell Perry, Lawrenceville, GA (US)

(73) Assignee: SM+C, Inc, Dunwoody, GA (US)

( * ) Notice: Subject to any disclaimer, the term of this patent is extended or adjusted under 35 U.S.C. 154(b) by 0 days.

(21) Appl. No.: 10/813,923

(22) Filed: Mar. 31, 2004

(65) Prior Publication Data

US 2005/0075187 A1 Apr. 7, 2005

Related U.S. Application Data

(63) Continuation of application No. 10/248,933, filed on Mar. 3, 2003, now abandoned, which is a continuation-in-part of application No. 10/248,397, filed on Jan. 15, 2003, now abandoned.

(51) Int. Cl.
*A63B 69/36* (2006.01)

(52) U.S. Cl. ..... 473/270; 473/217; 473/266

(58) Field of Classification Search ..... 473/207, 473/212, 218, 217, 450, 453, 458, 266, 269, 473/270, 271, DIG. 30; 602/23, 27; 482/74, 482/124

See application file for complete search history.

(56) References Cited

U.S. PATENT DOCUMENTS

| | | | | | |
|---|---|---|---|---|---|
| 4,706,957 | A * | 11/1987 | Jackson | 473/207 |
| 4,960,280 | A * | 10/1990 | Corder, Jr. | 473/212 |
| 5,016,885 | A * | 5/1991 | Quigley | 473/217 |
| 5,256,119 | A * | 10/1993 | Tudor | 482/74 |
| 5,460,385 | A * | 10/1995 | Lazzeroni | 473/464 |
| 5,643,184 | A * | 7/1997 | Toso | 602/19 |
| 5,938,548 | A * | 8/1999 | Upshaw | 473/453 |
| 5,993,362 | A * | 11/1999 | Ghobadi | 482/124 |
| 6,375,582 | B1 * | 4/2002 | Harris | 473/270 |
| 6,450,131 | B1 * | 9/2002 | Broman | 119/857 |
| 6,629,912 | B1 * | 10/2003 | Downs | 482/124 |
| 6,672,973 | B1 * | 1/2004 | Muntz | 473/217 |
| 2004/0137998 | A1 * | 7/2004 | Perry | 473/270 |

* cited by examiner

*Primary Examiner*—Nini F. Legesse
(74) *Attorney, Agent, or Firm*—Alvin S Perry

(57) ABSTRACT

The present invention relates generally to the game of golf and golf accessories more particularly, to an alignment device for setting a player's stance. This invention relates to golf training devices and the method of using the devices. Specifically disclosed herein is a device for stabilizing a golfer's feet and stance while the golfer practices the swing. The device may be employed in the process of hitting a golf ball or executing a swinging motion of a golf club without actually contacting a golf ball or a golf ball being present.

16 Claims, 6 Drawing Sheets

GOLF SWING STANCE STABILIZER

This is a continuation in part of patent application number (Ser. No. 10/248,933) filed (Mar. 3, 2003) now abandoned which is in turn a continuation in part of patent application number (Ser. No. 10/248,397) filed (Jan. 15, 2003) now abandoned.

FIELD OF THE INVENTION

The present invention relates generally to the game of golf and golf accessories more particularly, to an alignment device for setting a player's stance. This invention relates to golf training devices, and in particular discloses a device for stabilizing a golfer's feet and stance while the golfer practices the swing. This may be accomplished while hitting a golf ball or just swinging the golf club without the golf ball being present. This invention is particularly useful in assisting the golfer while practicing to improve their swing and ball flight. This invention also allows for the training of golfers to swing in the manner, which has long been recommended for producing the best results. The present invention assists golfers in properly positioning their feet and legs so as to achieve the appropriate recommended swing.

DESCRIPTION OF THE PRIOR ART

There exist prior devices that consist of lines and markings on a mat to assist a golfer in placing his feet parallel to each other and perpendicular to the intended path of a golf ball. Some such devices also have markings to assist in foot placement for achieving a fade or hook shot. The prior art does not disclose the arrangement of features of the present invention. In the game of golf, the player stance, i.e. the position of the player's feet with respect to the golf ball, is of the utmost importance in order to obtain a good golf shot. If the player's feet are improperly positioned when he or she addresses the ball a number of arrant shots such as, hooks, slices and others will frequently result. The proper stance for a player varies from one player and to the next. Furthermore, the proper stance also varies depending on the type of shot to be made. For example, a proper stance for a player using a driver will be different than the proper stance for an eight-iron shot, even for the same player. Most players determine their proper golf stance for the different golf shots only through practice and experience. However, every experienced golfer adopts improper golf stances after periods of golf inactivity. When this occurs, it often takes the golfer several practice sessions before he or she regains their proper golf stances.

BACKGROUND OF THE INVENTION

A successful game of golf unmistakably requires much practice and skill. Indeed, the sport demands accuracy in both the golfer's movements and stance on the golf course. Broadly stated, the present invention in its preferred form is a golf stance-stabilizing device having a positioning and alignment guidance strip and two foot gripping elements, means for locking and securing the feet. More specifically, the present invention is a golf stance-stabilizing device having each gripping device capable of being manually extended to a user-specified position and subsequently selectively locked or secured. In the description that follows the apparatus is described for right handed and left hand golfers. Various features and advantages will appear from the description given herein. In the description, reference is made to the accompanying drawing that, a specific embodiment for employing the invention. This embodiment will be described in sufficient detail to enable those skilled in the art to use or make the invention. It is to be understood that other embodiments may be utilized and that structural changes may be made without departing from the scope of the invention. Thereafter, when the golfer wishes to set his stance, for example during a period of training, the golfer's feet are positioned in the gripping elements and the positioning and alignment guidance strip is adjusted to the desired distance. Furthermore the device comprises means for providing good leg work and the correct body turn that is required for the proper golf swing. Briefly described, in a preferred embodiment, the present invention overcomes the above mentioned disadvantages, and meet the recognized need for such a device, by providing a golf stance stabilizing device wherein accurate alignment and guidance is provided for obtaining the proper stance position. The proper stance position, thus improves the golfer's swing.

A feature and advantage of the present invention is its quick, consistent and accurate utilization.

A feature and advantage of the present invention is its lockable guidance strips at desired extensions.

A feature and advantage of the invention is its ability to be employed by both amateur and expert golfers with ease.

A feature and advantage of the present invention is its portability.

A feature and advantage of the present invention is its ability to be stored away with ease.

It is yet another of this invention to provide a golf stance gauge, which can be used by left or right, handed golfers.

It is further object of this invention to provide a golf stance gauge, which can be used with a variety of different sizes and types of golf clubs.

It is another object of this invention to provide a golf stance gauge, which is safe to use and not interfere with the ball or club when the ball is being hit.

It is another object of this invention to provide a golf stance gauge, which can be personally calibrated by the golfer.

It is yet another object of this invention to provide a golf stance gauge, which is easy to assemble and use.

A further object of this invention is to provide an apparatus for establishing the proper distance between the feet and the golf ball.

Another object of this invention is to provide an apparatus including structure whereby proper distance between the left foot and the right foot may be maintained.

Yet another object of this invention is to provide an apparatus that will be capable of facilitating proper toe and heel alignment.

A further object of this invention is to provide an apparatus, which will be capable of facilitating proper swinging of the golfer without body sway.

A further object of this invention is to provide an apparatus, which will be capable of facilitating use of the invention indoor or outdoor.

A final object of this invention is to be specifically enumerated herein is to provide a golf swing practice aid in accordance with the preceding objects and which will conform to conventional forms of manufacture, be of simple construction and easy to use so as to provide a device that will be economically feasible, long lasting and relatively trouble-free in operation.

These and other objects, features and advantages of the invention will become more apparent to one skilled in the art of teaching and playing the game of golf.

SUMMARY OF THE PRESENT INVENTION

In a preferred embodiment, the device includes at least one a left foot gripping means and a right foot gripping means, and are engaged by an adjustable mechanism, for securing a golfer's feet parallel to each other in a given stance while the golfer practices golf swing. The gripping means can be slid nearer or farther away from each other and locked in the selected position to provide a variety of widths of stance. The gripping means further comprising at least two opposing elastic straps to be attached to one another and adjustable to the size of the golfers shoe/foot. The straps may further comprise conventional attaching means such as mating Velcro, two-part, snap fit buttons, or other like means. The adjusting mechanism further comprises two opposing elastic straps to be attached to one another and adjustable to the golfer's width of stance. The device is thus useful as a training device in order to prevent the golfer from getting his feet in the wrong orientation to each other during the course of his swing. The device also includes a coiling strap or means for preventing a golfer's weight from moving laterally outside (swaying) the rear leg, the leg opposite of the intended target side foot, which is the right foot of a right handed golfer and the left foot of a left handed golfer. The device also includes a coiling strap or means for preventing a golfer's weight from moving laterally outside (sliding) the forward leg, the leg on the same side of the intended target side foot, which is the left foot of a right handed golfer and the right foot of a left handed golfer. The correct employment of the coiling straps forces the upper body of the golfer to rotate against the lower body, resulting in a coiling movement. The correct employment of the coiling straps forces the upper body of the golfer to also rotate with the lower body, resulting in an uncoiling movement. The device also enables the beginning golfer to start practicing the golf swing with the feet parallel but close together, and gradually work his or her way up to a wider stance.

The basic purpose of the invention is to provide a means of stabilizing the golfer's feet and legs while swinging the golf club. To that end, the invention provides:

List of Components

A) A positioning and alignment device; used to adjust the width of the right and left foot gripping elements B) A left foot gripping element; used to secure the left foot to the positioning and alignment device C) A right foot gripping element; used to secure the right foot to the positioning and alignment device D) A coiling strap or means for preventing a golfer's weight from moving outside the rear leg E) A coiling strap or means for preventing a golfer's weight from moving outside the forward leg A preferred arrangement for the gripping means is to have each of the elastic straps comprising adjustable complementary mechanically adhesive strips sewn to the adjusting mechanism in order to secure rapidly a variety of sizes of golfer's shoes.

Another purpose of the invention is to provide a means of allowing the golfer to advance his practicing of his swing from a narrow stance to a wide stance. One of the most common errors of a beginning golfer is twisting his feet on the ground during the course of his swinging of a golf club. It is usually easier for a golfer to maintain throughout his swing the correct parallel orientation of his feet when they are close together. After the golfer has mastered this continuing orientation in a narrow stance with the aid the foot gripping means of the device of this invention, the golfer can readily progress to practicing the golf swing while keeping the feet parallel while in a wider stance. The wider stance is eventually desirable to provide a solid framework from which to swing the club and connect with great power to the ball.

The invention provides golfer stance width position range from a beginning golfer's narrow stance, to an advanced golfer's correct stance.

In addition to the means that allow the width of a golfer's stance to be adjusted, the invention also provides means for a golfer to also produce the correct body turn required for a proper swing By obtaining the proper stance and providing a means for maintaining the balanced weight distribution, the golfer shifts emphasis to the shoulders and arms to achieve an error free golf swing. Practice with the present invention will assist the golfer in learning the correct position of his body, and in maintaining balance in this position, throughout the golf swing.

BRIEF DESCRIPTION OF THE DRAWINGS

The present invention will be better understood by reading the detailed description of the preferred embodiments.

DETAILED DESCRIPTION OF THE PREFERRED EMBODIMENT

Figure 1:
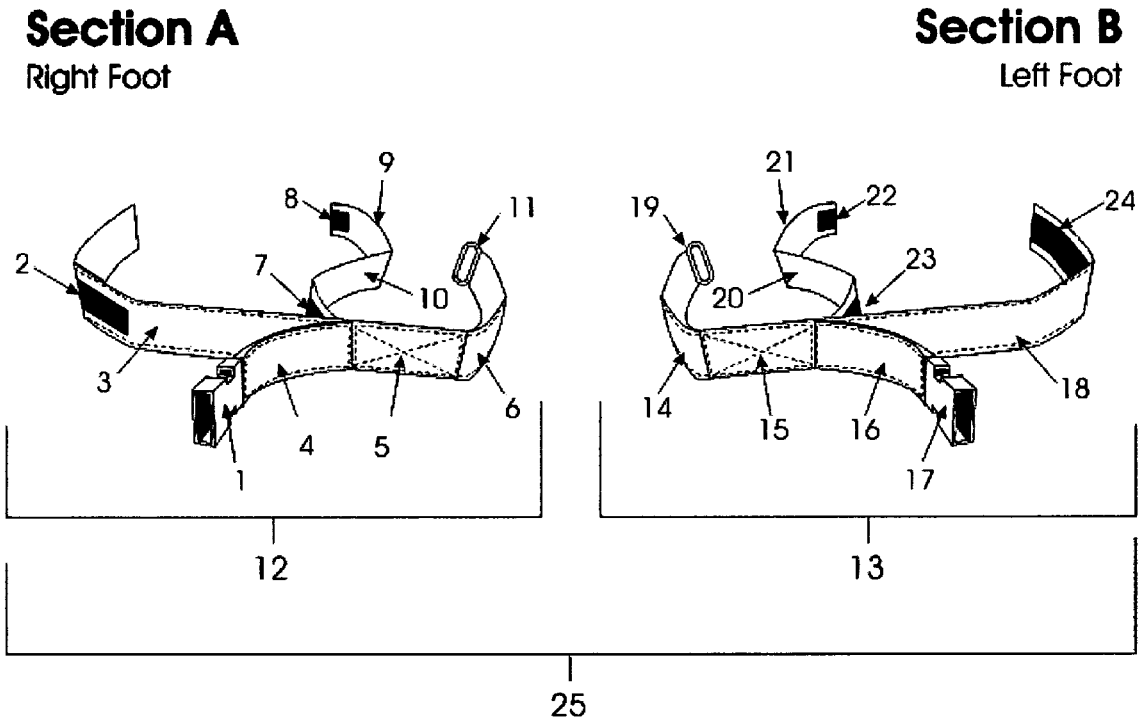
FIG. 1 is a perspective view of the component of the golf swing stance stabilizer that is used to adjust the width of the golfer's stance.
Figure 2:
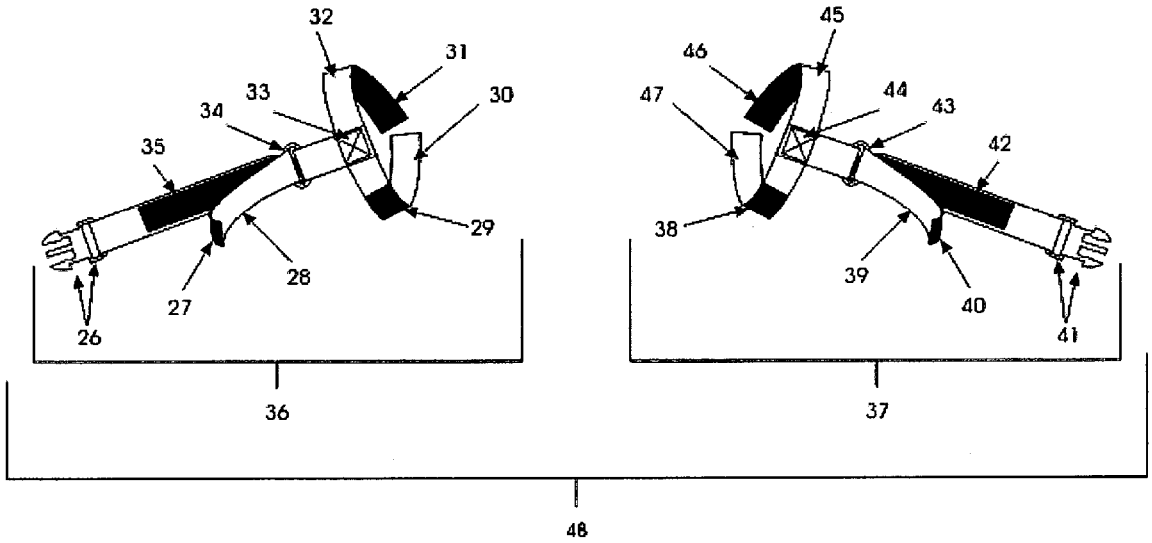
FIG. 2 is a perspective view of the component of the golf swing that is used to maintain the balanced weight distribution.

In describing the preferred embodiment of the present invention, as illustrated in FIGS. 1 and 2, simple terminology is employed for the sake of clarity. The invention is not to be limited to the simple terminology so selected, and it is to be understood that each specific element includes all technical equivalents that operate in a similar manner to accomplish similar functions.

Referring now to FIG. 1 the present invention in its preferred embodiment is a golf stance stabilizer 25 and 48. As best shown in FIGS. 1 and 2, the stabilizer 25 and 48 includes a rear foot gripping element that is further comprised of elements 1–11. The stabilizer 25 and 48 also comprises a second or forward foot gripping element. The forward foot gripping element is further comprised of elements 14–24. The optional coiling straps 48 as seen in FIG. 2 is comprised of elements 26–35 and 38–47.

Figure 3:
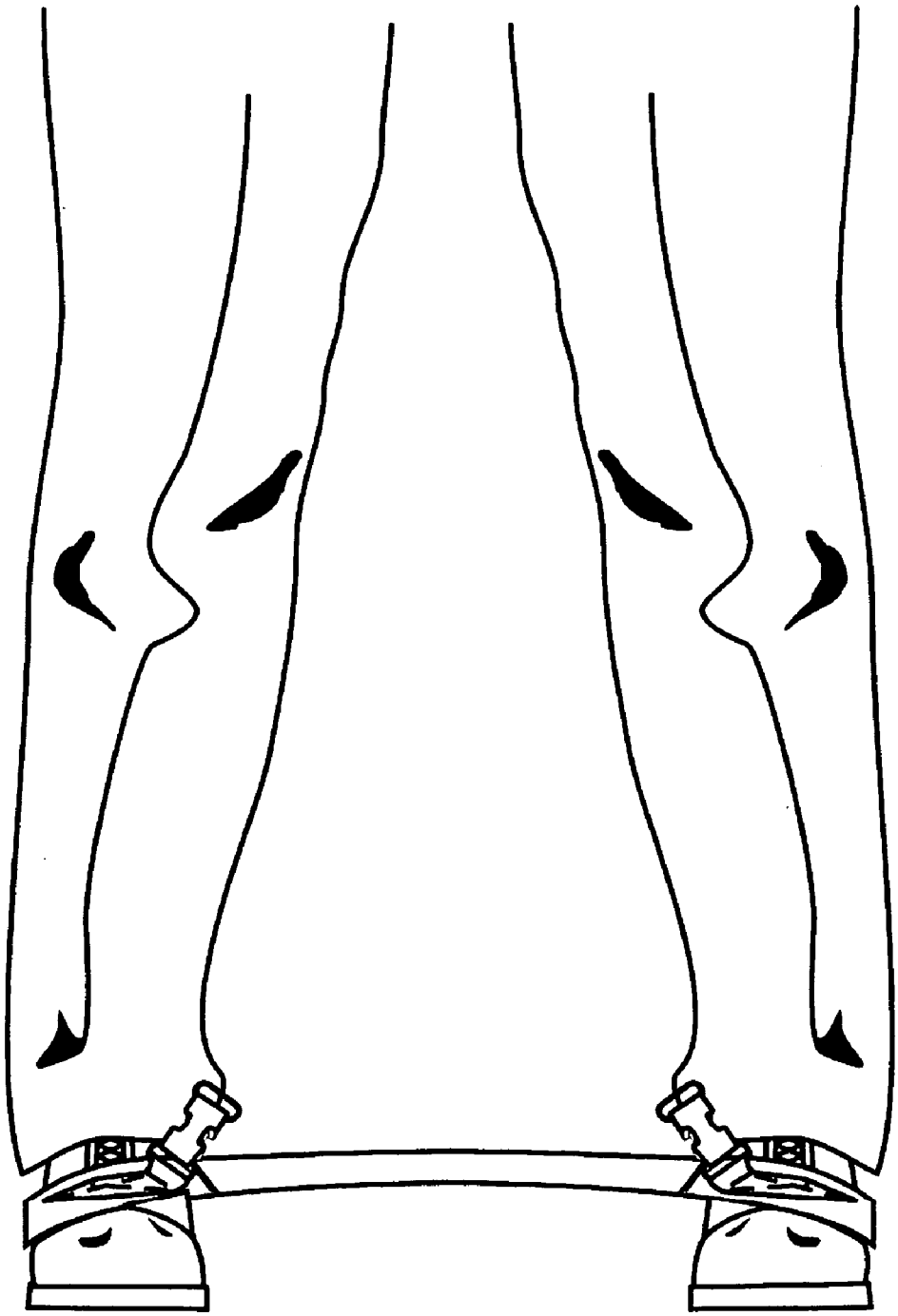
FIG. 3 is a three dimensional view of the stance width adjust component of the golf swing stance stabilizer as placed on a golfers shoe/feet.
Figure 4:
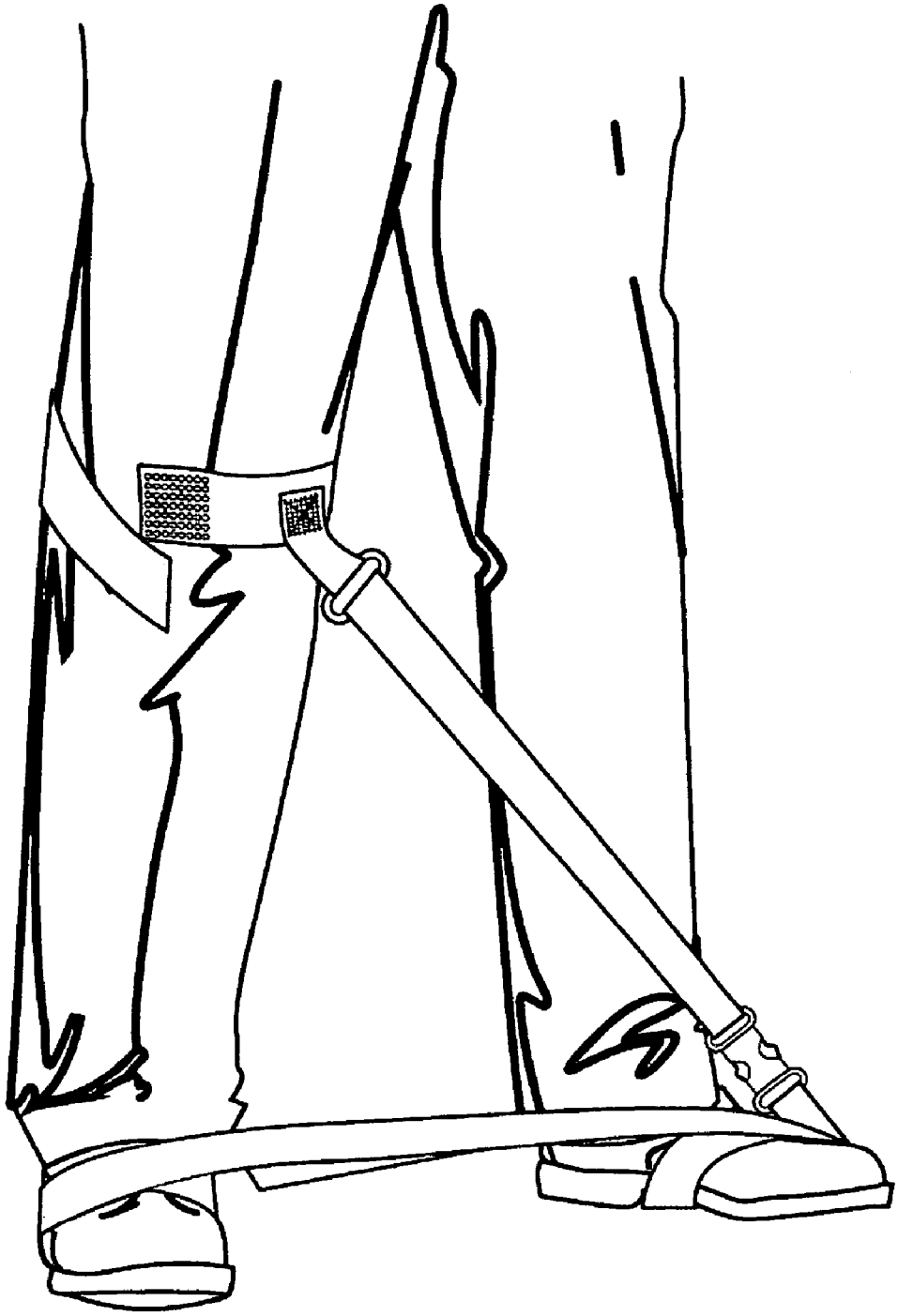
FIG. 4 is a three dimensional view of the stance width adjust component of the golf swing stance stabilizer as placed on a golfers shoe/feet and the attachable coiling strap or means for preventing a golfer's weight from moving outside the rear leg.
Figure 5:
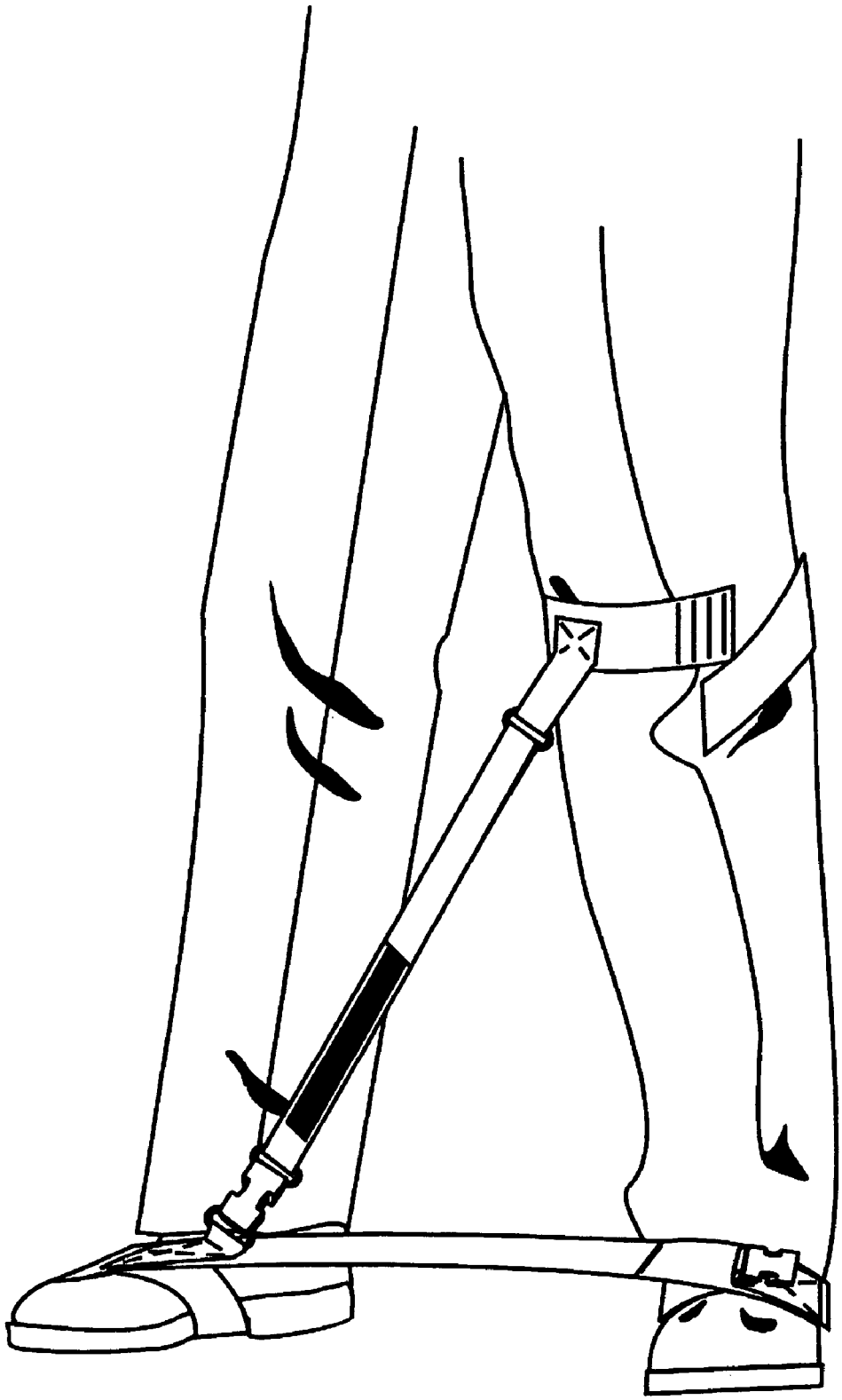
FIG. 5 is a three dimensional view of the stance width adjust component of the golf swing stance stabilizer as placed on a golfers shoe/feet and the attachable coiling strap or means for preventing a golfer's weight from moving outside the forward leg.

The rear foot gripping element comprises straps 7, 8, 9, 10, 11 and base strap 6 that are appropriately attached to strap 3 as in FIG. 1 by way of conventional stitching 5. The first rear foot strap 9 and 10 includes an attaching means 6, 7, 8 and 11 that is used to attach the first strap 9 and 10 to the second rear foot strap 6 by taking forward strap 9 and 10 through ring 11 being securely engaged with the attaching means 8 to attaching means 7 of forward foot strap 9 and 10. The first and second rear foot straps 6, 9 and 10 allow a golfer to secure his/her forward foot within the rear foot gripping element as seen in FIG. 3. The strap 4 comprises complimentary end 1 of an attach means used to attach the optional coiling strap 36 to the forward foot gripping element. As seen in the figures the complimentary end is the female element of snap-fit attachment. Upon insertion of the male end 26, the coiling strap is securely engaged with the rear foot gripping element. The coiling strap further comprises an adjustable strap 28. The adjustable strap capable of being lengthened as well as shortened according to a golfer's stance. The adjustment can be made by sliding the strap in the appropriate direction through ring 34. After the desired length of the coiling strap is selected, the length is secured by attaching mating attaching means 27 to the complimentary attaching means 35. A second strap is attached to ring 34 and further attached the second strap via stitching 33 is a third strap 32 comprising attaching means 31 and 29 for connecting the ends of the third strap. The forward foot gripping element comprises straps 20, 21, 22, 23, 19 and base strap 14 that are appropriately attached to strap 18 as in FIG. 1 by way of conventional stitching 15. The first forward foot strap 20 and 21 includes an attaching means 14, 22, 23 and 19 that is used to attach the first strap 20 and 21 to the second forward foot strap 6 by taking forward strap 20 and 21 through ring 19 being securely engaged with the attaching means 22 to attaching means 23 of forward foot strap 20 and 21. The first and second forward foot straps 14, 20 and 21 allow a golfer to secure his/her forward foot within the forward foot gripping element as seen in FIG. 3. The strap 16 comprises complimentary end 17 of an attach means used to attach the optional coiling strap 37 to the forward foot gripping element. As seen in the figures the complimentary end is the female element of snap-fit attachment. Upon insertion of the male end 41, the coiling strap is securely engaged with the forward foot gripping element. The coiling strap further comprises an adjustable strap 39. The adjustable strap capable of being lengthened as well as shortened according to a golfer's stance. The adjustment can be made by sliding the strap in the appropriate direction through ring 43. After the desired length of the coiling strap is selected, the length is secured by attaching mating attaching means 40 to the complimentary attaching means 42. A second strap is attached to ring 43 and further attached the second strap via stitching 44 is a third strap 45 comprising attaching means 46 and 38 for connecting the ends of the third strap.

The forward foot gripping element may also include a first and second strap attached to a base strap. However, as seen in the embodiment of FIG. 1, the base strap 18 of the forward foot gripping element is also the equivalent of the second strap 3 of the rear foot gripping element. As seen in the figures, the forward foot gripping element and the rear foot gripping element make up the means for adjusting the width of the stance when both components are attached to one another by mating attaching means 18 and 3, respectively. The attaching means 24 and 2 of the base straps 18 and 3 comprise the adjusting mechanism used to establish the desired width between the forward foot gripping element and the rear foot gripping element.

When in use, the stabilizer may be employed as illustrated in FIG. 3, 4, 5 or 6. The golfer first selects the desired golf shot he wishes to execute. With the golf shot selected, the golfer places his forward foot in the unattached forward foot gripping means and secures his foot therein by attaching means 22 and 23 of straps 14, 20 and 21 through ring 19, respectively. Next, the golfer places his rear foot in the unattached rear foot gripping means and secures his foot therein by attaching means 7 and 8 of straps 9, 10 and 6 through ring 11 respectively. The golfer then determines the appropriate stance required or desired to complete the shot. In particular, the golfer selects the width between his forward foot and rear foot. With the forward foot gripping means secured and the rear foot gripping means secure the golfer adjusts or ensures his rear foot is in the correct position and selected width and then attaches the two gripping element together by attaching means 24 and 2. The golfer may then execute the golf shot or practice swing with a stabilized stance.

The detailed description is, therefore, not to be taken in a limiting sense, and the scope of the present invention is best defined by the appended claims. In order to use the golf stance device of the present invention, the golfer determines his or her proper stance for a particular golf shot in any conventional fashion, such as on a driving range or indoor facility.

Optionally, before executing the shot, a golfer may choose to employ the use of the coiling strap 37 by first attaching it to the forward foot gripping element. Once the coiling strap is attached to the device the length of the strap is adjusted in order to allow it to extend in a diagonal direction from the forward foot to a location in an area near the knee of the rear leg. The golfer then attaches the coiling strap around the leg in the area near the knee by wrapping and securing strap 45. The length of the strap is then secured by attaching means 46 and 38, FIG. 4. With the optional coiling means employed the golfer may then execute a golf shot or practice swing with a stabilized stance and balanced weight distribution.

The detailed description is, therefore, not to be taken in a limiting sense, and the scope of the present invention is best defined by the appended claims. In order to use the golf stance device of the present invention, the golfer determines his or her proper stance for a particular golf shot in any conventional fashion, such as on a driving range or indoor facility.

Optionally, before executing the shot, a golfer may choose to employ the use of the coiling strap 36 by first attaching it to the rear foot gripping element. Once the coiling strap is attached to the device the length of the strap is adjusted in order to allow it to extend in a diagonal direction from the forward foot to a location in an area near the knee of the rear leg. The golfer then attaches the coiling strap around the forward leg in the area near the knee by wrapping and securing strap 32. The length of the strap is then secured by attaching means 31 and 29, FIG. 5. With the optional coiling means employed the golfer may then execute a golf shot or practice swing with a stabilized stance and balanced weight distribution.

The detailed description is, therefore, not to be taken in a limiting sense, and the scope of the present invention is best defined by the appended claims. In order to use the golf stance device of the present invention, the golfer determines his or her proper stance for a particular golf shot in any conventional fashion, such as on a driving range or indoor facility.

Figure 6:
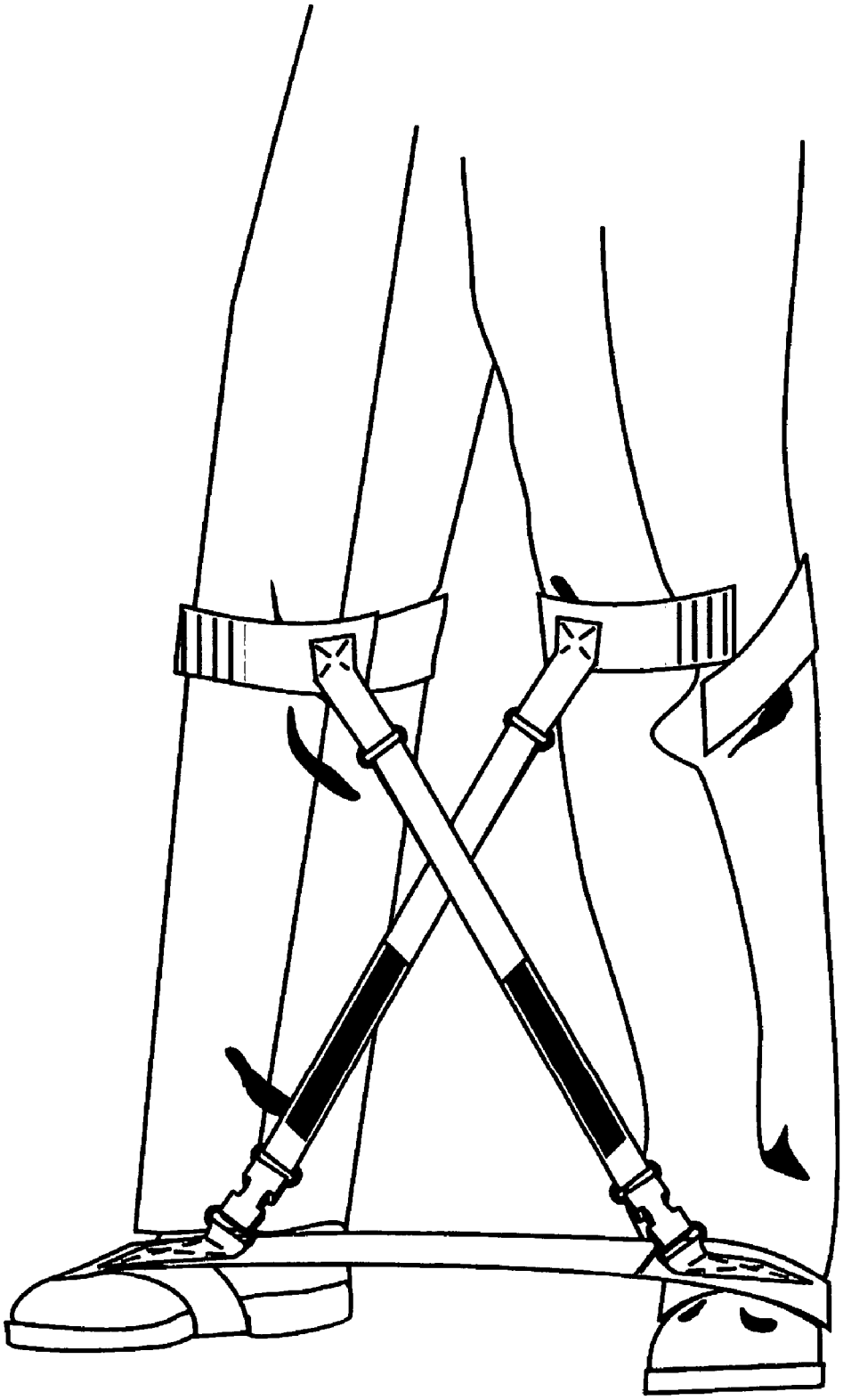
FIG. 6 is a three dimensional view of the stance width adjust component of the golf swing stance stabilizer as placed on a golfers shoe/feet and the attachable coiling straps or means for preventing a golfer's weight from moving outside the rear leg & forward leg.

Optionally, before executing the shot, a golfer may choose to employ the use of the coiling strap 36 and coiling strap 37 by first attaching strap 36 to the rear foot gripping element. Once the coiling strap is attached to the device the length of the strap is adjusted in order to allow it to extend in a diagonal direction from the forward foot to a location in an area near the knee of the rear leg. The golfer then attaches the coiling strap around the forward leg in the area near the knee by wrapping and securing strap 32. The length of the strap is then secured by attaching means 31 and 29. The golfer can then attach strap 37 to the forward foot gripping element. Once the coiling strap is attached to the device the length of the strap is adjusted in order to allow it to extend in a diagonal direction from the forward foot to a location in an area near the knee of the rear leg. The golfer then attaches the coiling strap around the leg in the area near the knee by wrapping and securing strap 45. The length of the strap is then secured by attaching means 46 and 38. The process is illustrated in FIG. 6. With the optional coiling means employed the golfer may then execute a golf shot or practice swing with a stabilized stance and balanced weight distribution.

The detailed description is, therefore, not to be taken in a limiting sense, and the scope of the present invention is best defined by the appended claims. In order to use the golf stance device of the present invention, the golfer determines his or her proper stance for a particular golf shot in any conventional fashion, such as on a driving range or indoor facility.

Having described the invention, however, many modifications thereto will become apparent to those skilled in the art to which it pertains without deviation from the spirit of the invention as defined by the scope of the appended claims. For example, for economic feasibility the straps herein are manufactured from a fabric; however, the straps may be also manufactured from other materials such as plastics, polymers, or other synthetics.

What is claimed:

1. A golf stance stabilizing apparatus for executing a golf shot, the apparatus comprising a forward foot gripping element including means for securing a forward foot, a rear foot gripping element including means for securing a rear foot, and a stance adjustment mechanism means for adjusting and selecting a desired distance between said forward foot gripping element and rear foot gripping element to minimize movement of a golfer's feet and maintain said golfers feet in a parallel configuration with respect to each other, wherein said stance adjustment mechanism is arranged horizontally between and connected to said gripping elements at a point on the golfer's feet and maintains the selected distance therebetween.

2. The apparatus of claim 1 where in said stance adjustment means is comprised of two opposing, complimentary attaching means connectable together.

3. The apparatus of claim 1 wherein said means for securing a forward foot comprises two opposing straps releasably attachable to each other.

4. The apparatus of claim 1 wherein said means for securing a rear foot comprises two opposing straps releasably attachable to each other.

5. The apparatus of claim 4, wherein the two opposing straps are releasably attached to each other by buttons or fabric.

6. The apparatus of claim 5 wherein said two opposing straps are further attached to a base strap.

7. The apparatus of claim 1 wherein said forward foot gripping element further comprises a base strap.

8. The apparatus of claim 1 wherein said rear foot gripping element further comprises a base strap.

9. The apparatus of claim 1 wherein said means for securing a rear foot and said means for securing a forward foot each comprise a base strap and two opposing straps being releasably attachable to each other, wherein said opposing straps are attached to said base strap.

10. The apparatus of claim 1 wherein at least one of said forward foot and rear foot gripping elements further comprise a means for attaching an additional strap, an additional strap is attached to said means for attaching, wherein the additional strap further comprises a complimentary means for attachment at a first end to be releasably connected to said means for attaching an additional strap.

11. The apparatus of claim 10 wherein the length of the additional strap is capable of being adjusted.

12. The apparatus of claim 11, wherein the additional strap further comprises a means for attaching the additional strap to a person's leg at a second end opposite said first end.

13. The apparatus of claim 10, wherein said forward and rear feet gripping elements both comprise a means for attaching an additional strap and respective additional straps connected thereto.

14. The apparatus of claim 13, wherein the additional straps further comprises a means for attaching the additional straps to both a person's legs at a second end opposite said first end.

15. The apparatus of claim 14 wherein the additional straps extend from respective gripping elements to an opposing leg of the golfer thereby crossing and being attached at the second ends in an area near the golfer's knees.

16. A method of executing or practicing a golf shot, the method comprising the steps of providing a golf stance stabilizing apparatus comprising an unattached forward foot gripping element including means for securing a forward foot, an unattached rear foot gripping element including means for securing a rear foot, a means for maintaining balanced weight distribution and a means for adjusting the separation distance between said forward foot gripping element and rear foot gripping element, wherein said means for maintaining balanced weight distribution comprises a first strap capable of being releasably attached to the forward foot gripping element via a first end and a second strap capable of being releasably attached to the rear foot gripping element via a first end the method comprising: placing a forward foot in said unattached forward foot gripping element and securing said forward foot therein, placing a rear foot in said unattached rear foot gripping element and securing said rear foot therein, determining an appropriate stance or width between said forward foot and said rear foot, adjusting said rear foot to said width, attaching said gripping elements together, attaching one of said first and second straps of the weight distribution means to said respective gripping element, adjusting the length of said one strap to length to allow it to extend to a position near the knee of an opposing leg and attaching said one strap thereto, attaching the remaining strap of said first and second straps of the weight distribution means to said respective gripping element, adjusting the length of said one strap to length to allow said remaining strap to extend cross said one strap to a position near the knee of an opposing leg and attaching said remaining strap thereto, and executing the golf shot.

* * * * *